US008176827B2

(12) United States Patent
Emde

(10) Patent No.: US 8,176,827 B2
(45) Date of Patent: May 15, 2012

(54) HAND GUN

(75) Inventor: Dietmar Emde, Arnsberg (DE)

(73) Assignee: German Sport Guns GmbH, Ense-Höingen (DE)

( * ) Notice: Subject to any disclaimer, the term of this patent is extended or adjusted under 35 U.S.C. 154(b) by 0 days.

(21) Appl. No.: 12/874,414

(22) Filed: Sep. 2, 2010

(65) Prior Publication Data

US 2011/0047848 A1 Mar. 3, 2011

(30) Foreign Application Priority Data

Sep. 2, 2009 (DE) ..... 10 2009 039 669

(51) Int. Cl.
*F41A 19/34* (2006.01)

(52) U.S. Cl. ..... 89/1.4; 89/1.42

(58) Field of Classification Search ..... 89/1.4, 89/1.42
See application file for complete search history.

(56) References Cited

U.S. PATENT DOCUMENTS

| | | | | |
|---|---|---|---|---|
| 2,826,848 | A * | 3/1958 | Davies | 42/71.01 |
| 5,179,245 | A * | 1/1993 | Straka | 89/1.4 |
| 6,019,024 | A | 2/2000 | Robinson et al. | |
| 6,655,069 | B2 * | 12/2003 | Kim | 42/114 |
| 7,231,861 | B1 | 6/2007 | Gauny et al. | |
| 2002/0046642 | A1 * | 4/2002 | Murello | 89/1.42 |
| 2007/0240352 | A1 * | 10/2007 | Pullicar | 42/70.11 |
| 2011/0036232 | A1 * | 2/2011 | Dublin | 89/1.4 |

FOREIGN PATENT DOCUMENTS

| | | | |
|---|---|---|---|
| DE | 199 030321 | B4 | 8/2000 |
| DE | 10 2006 006 034 | B3 | 10/2007 |
| DE | 102009039669 | A1 | 3/2011 |

* cited by examiner

*Primary Examiner* — Gabriel Klein
(74) *Attorney, Agent, or Firm* — Maine Cernota & Rardin

(57) ABSTRACT

The present invention relates to a hand gun with a tensioning lever (cocking lever), connected with the lock, with a handle for cocking the weapon, for which at least two alternative fastening positions are provided for the handle for actuating the tensioning lever. The relative position of the handle for actuating the tensioning lever is changeable on the weapon, so that one can engage for cocking in various positions on either the right hand or left hand side, so that the tensioning lever can be adjusted to fit and be operated by a right-handed or a left-handed person.

11 Claims, 3 Drawing Sheets

HAND GUN

RELATED APPLICATIONS

This application claims priority from German Application No. DE 10 2009 039 669.1, filed Sep. 2, 2009, which is herein incorporated by reference in its entirety for all purposes.

FIELD OF INVENTION

The present invention relates to a hand gun with a tensioning lever (cocking lever), connected with the lock, which lever has at least one handle for cocking the weapon.

BACKGROUND OF THE INVENTION

A self-loading hand gun is a firearm or weapon known from the prior art, in which the tensioning lever is securely connected with the lock. A hand gun of the type named in the introduction is described for example in DE 10 2006 006 034 B. There, the handle, connected with the tensioning lever, is arranged at the rear end of the housing of the weapon. The tensioning lever has a T-shaped hand grip there, which projects out from the housing and on which two handles are arranged on both sides of the weapon. Cocking takes place by drawing back the tensioning lever in the longitudinal direction of the weapon. The T-shaped hand grip has the advantage that the tensioning lever can be operated both by a right-handed person and also by a left-handed person. However, in this known solution, the relative position of the tensioning lever in relation to the housing of the weapon is established at its rear end.

SUMMARY OF THE INVENTION

An object of the present invention consists in providing a hand gun of the type named in the introduction, which is designed such that the relative position of the handle for actuating the tensioning lever is changeable on the weapon.

The solution to this problem is provided by a hand gun of the type named in the introduction, having the characterizing features of the claims.

According to one aspect of the invention, provision is made that, viewed in the longitudinal direction of the weapon, at least two alternative fastening positions, spaced apart from each other, are provided for the handle for actuating the tensioning lever.

Preferably, at least three fastening positions, respectively spaced apart from each other in the longitudinal direction of the housing, are provided along the housing for the handle for actuating the tensioning lever. The user therefore has the possibility of selecting the position of the handle for actuating the tensioning lever as required, as appears to him to be the most comfortable and the most favourable when handling the weapon.

In addition, according to one embodiment of the present invention, provision is made that both on the right-hand side and also on the left-hand side of the housing, at least respectively one fastening position, preferably at least respectively two alternative fastening positions, respectively spaced apart from each other in the longitudinal direction of the housing, are arranged for the handle for actuating the tensioning lever. Through this measure, it is possible to produce a weapon which can be used uniformly both by right-handed people and also by left-handed people. This is particularly advantageous for logistics in the military field, because then two different models do not have to be stored for one weapon type. Preferably, the rearmost fastening position here is situated with some distance in front of the rearmost end of the weapon and the further fastening positions lie further towards the front.

It is also possible to provide a handle for actuating the tensioning lever respectively both on the right hand side and also on the left hand side of the housing (bi-manual handle), so that in this case it is even possible that selectively a left-handed person or a right-handed person uses the weapon, without it first being necessary to release the handle from its position and mount it on the other side of the weapon.

According to another embodiment of the invention, the handle for actuating the tensioning lever is releasable by releasing a screw connection out of its respective fastening position. It is therefore very simple to alter the respective fastening position of the handle. The latter can be fastened for example so that it can be unscrewed without a tool, by hand out from its fastening position and screwed in, in another position. For example, at its end facing the weapon, the handle has a thread which is associated with a corresponding thread in the tensioning lever. The latter thread can lie for example inside the housing in the region of the groove, so that when the handle is fastened it is not visible from the exterior. The handle can, for example, be a kind of pin which projects on the housing, protruding laterally outwards from the groove.

Yet another embodiment of the invention provides that a groove, open towards the exterior, on the housing of the hand gun is associated with at least one fastening position of the handle, into which groove the handle partially engages radially.

An element of the handle and/or a connecting element to the tensioning lever may be guided in the above-mentioned groove in a longitudinal direction during the cocking motion or movement for cocking of the hand gun in preparation for discharging a round.

In addition, a groove, open towards the exterior, on the housing of the weapon may be associated with each fastening position of the handle, into which groove the handle partially engages radially (in transverse direction) and the length of this groove, in which the handle may be guided in a movable manner, corresponds respectively approximately to the cocking path of the tensioning lever.

An element, projecting outwards out of the groove, which is connected with the tensioning lever or which is a part of the tensioning lever, may form the handle for its actuation and may be constructed for example for instance in the manner of a knob or button. This element can, for example, be connected with a shaft which projects in radial direction into the groove and is guided in the latter.

Other features identified in the claims relate to additional aspects of the invention. Further advantages of the invention will be apparent from the following detailed description.

BRIEF DESCRIPTION OF THE DRAWINGS

The present invention is described in further detail below with the aid of example embodiments with reference to the attached drawings, in which.

DETAILED DESCRIPTION

Figure 1:
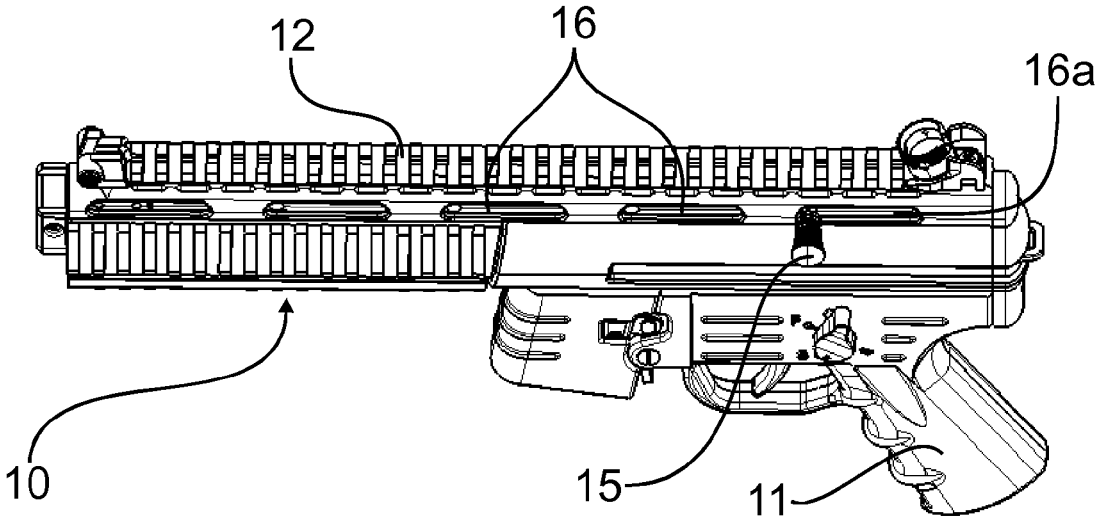
FIG. 1 shows a perspective view of a self-loading pistol according to the present invention with a handle for actuating the tensioning lever.

Firstly, reference is made to FIG. 1. The illustration shows a self-loading piston 10, in principle of conventional type of construction with a grip piece 11, a housing 12 and a lock arranged slidingly with respect to the housing in the shooting direction. A tensioning lever (cocking lever), which is connected with a handle 15, is connected with the locking system. For cocking, the tensioning lever is moved contrary to the shooting direction towards the rear end of the weapon. Several spaced grooves 16 are preferably situated respectively on each side of the weapon, wherein the handle 15 is associated at least with one of these grooves 16*a*. In FIG. 1 of the drawings, the handle is situated in the rearmost groove 16*a* on the left hand side of the weapon in the position of rest, in which it is situated as is seen at the front end of the groove 16*a*. For cocking the weapon, one grips on the handle 15 and by means thereof draws the tensioning lever and hence the lock towards the rear.

Figure 2:
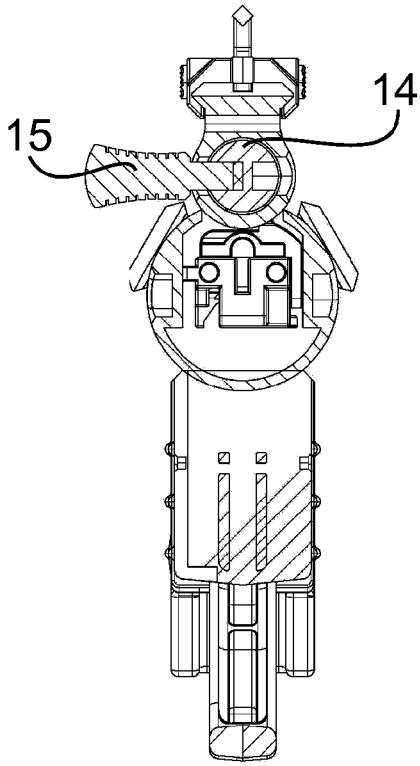
FIG. 2 shows a vertical section through the weapon of FIG. 1.

FIG. 2 shows a diagrammatic vertical section through the weapon of FIG. 1, wherein the handle 15 can be seen, projecting into the groove of the housing and aligned in transverse direction, which is securely connected in the mounted position with the tensioning lever extending in longitudinal direction in the housing. The handle 15 is, however, releasable from the tensioning lever for example after releasing of a screw connection, and can also be connected therewith in an alternative position (relative to the weapon).

Further details in this respect are apparent from the diagrammatic illustrations of FIGS. 3*a* to 3*d* and 4*a* to 4*c*. In FIGS. 3*a* to 3*d*, the tensioning lever 14 is illustrated diagrammatically, wherein the housing of the weapon is not shown. In the various illustrations of FIGS. 3*a* to 3*d*, the handle 15 is situated in respectively different positions on the tensioning lever 14. The tensioning lever 14 has a connecting element 13 for connection with the locking system, which is not illustrated here. In addition, several threaded bores 17 are seen in spaced positions laterally on the tensioning lever 14. The handle 15 is provided at its end facing the tensioning lever 14 with a corresponding threaded piece, so that the handle can be selectively screwed into one of the threaded bores 17 and fastened there. On drawing back, the tensioning lever 14 is moved towards the rear against the force of a diagrammatically indicated spring 18.

Figure 3A:
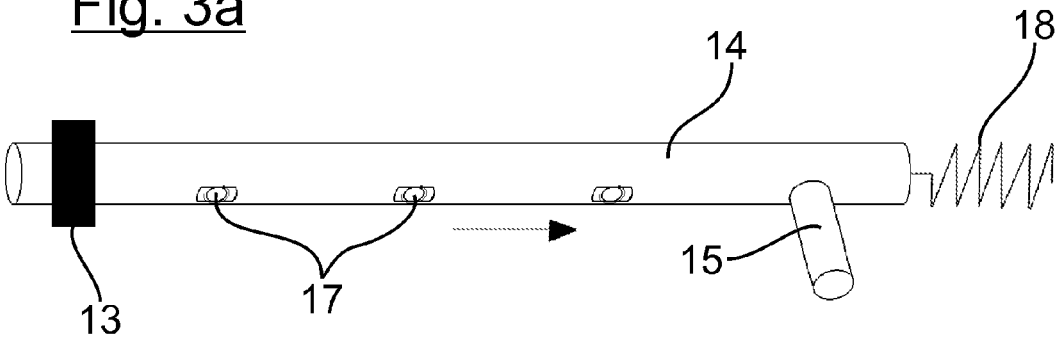
FIGS. 3*a*-3*d* show four diagrammatically simplified illustrations respectively as a side view, which show a handle according to the invention in various positions on the tensioning lever.
Figure 3B:
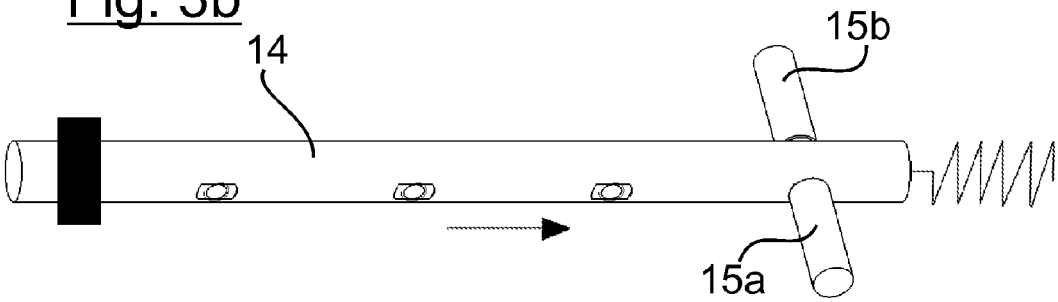

In FIG. 3*b* a variant is illustrated, in which two handles 15*a* and 15*b* are arranged on the tensioning lever 14 at the same height and in positions lying opposite each other, so that they are situated on the right hand side and on the left hand side of the weapon and permit an operation by right-handed people or left-handed people.

Figure 3C:
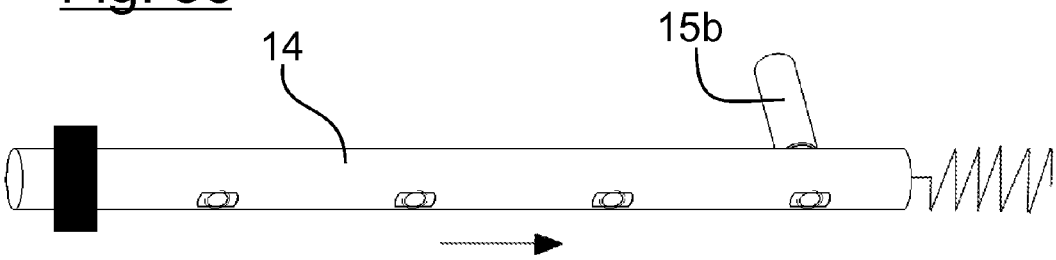
Figure 3D:
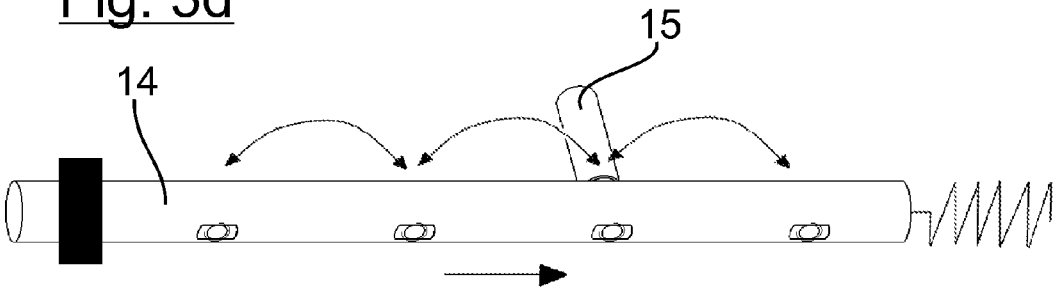

FIG. 3*c* shows a variant in which the handle 15 is again situated in the rearmost position, but here on the right hand side of the weapon. In FIG. 3*d*, the handle was fastened in a position lying further towards the front and it is indicated by the arrows that the handle is releasable from its position on the tensioning lever respectively by unscrewing and is able to be fastened in another position.

Figure 4A:
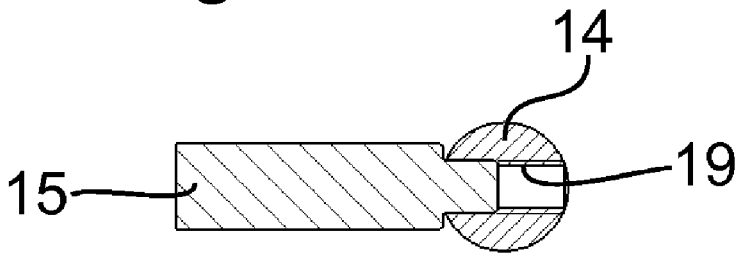
FIGS. 4*a*-4*c* show three diagrammatically simplified sectional illustrations which explain the principle of fastening the handle according to the invention.
Figure 4B:
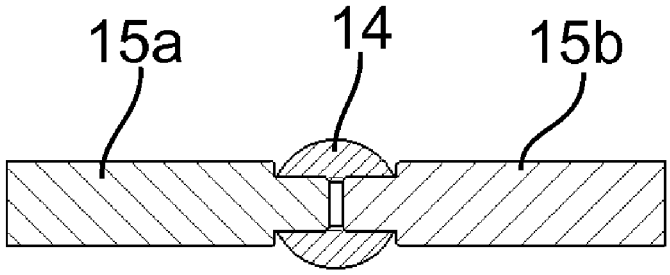
Figure 4C:
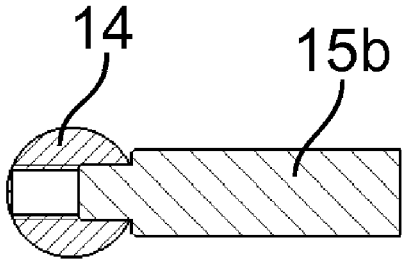

Further details are apparent from the diagrammatic sectional illustrations of FIGS. 4*a* to 4*c*. FIG. 4*a* shows here a position corresponding in principle to FIG. 3*a*, in which the handle 15 is situated on the left on the tensioning lever. In this sectional illustration, a thread 19 can also be seen in a threaded bore of the tensioning lever 14. In this example embodiment, the handle 15 is a type of pin, which narrows on the end side and has a thread there, which engages into the internal thread 19 in the threaded bore (transverse bore) of the tensioning lever 14. The handle therefore extends transversely to the tensioning lever and to the longitudinal extent (shooting direction) of the housing of the weapon. As FIG. 2 shows, the handle can also be slightly thickened on the outer side and can be constructed for example approximately in the manner of a knob.

FIG. 4*b* shows the variant of FIG. 3*b* in section with handles 15*a*, 15*b* arranged on both sides on the tensioning lever 14. FIG. 4*c* shows the variant of FIG. 3*c*, in which only a handle 15*b* is arranged on the right hand side of the tensioning lever 14.

Referring to the figures and the list of reference numbers generally, the invention is susceptible of other and various embodiments. For example, there is a hand gun with a tensioning lever (cocking lever), connected with the lock, which has at least one handle for cocking the weapon, characterized in that viewed in the longitudinal direction of the housing (1), at least two alternative fastening positions, spaced apart from each other, are provided for the handle (15) for actuating the tensioning lever (14).

The hand gun may be further characterized in that along the housing at least three fastening positions, respectively spaced apart from each other in the longitudinal direction of the housing, are provided for the handle (15) for actuating the tensioning lever (14).

The hand gun may characterized in that both on the right hand side and also on the left hand side of the housing, respectively at least one fastening position, preferably at least respectively two alternative fastening positions, respectively spaced apart from each other in the longitudinal direction of the housing, are arranged for the handle (15*a*, 15*b*) for actuating the tensioning lever (14).

The hand gun may also be characterized in that the handle (15) to actuate the tensioning lever (14) is releasable from its respective fastening position by releasing a screw connection.

The hand gun may also be characterized in that a groove (16), open towards the exterior, on the housing (12) of the weapon is associated with at least one fastening position of the handle (15), into which groove the handle partially engages radially.

The hand gun may also be characterized in that an element of the handle (15) and/or a connecting element to the tensioning lever (14) is guided in a groove (16) in the longitudinal direction on the movement for cocking.

The hand gun may also be characterized in that a groove (16), open towards the exterior, on the housing of the weapon is respectively associated with each fastening position of the handle (15), into which groove the handle (15) partially engages radially (in transverse direction) and the length of this groove corresponds respectively approximately to the cocking path of the tensioning lever (14).

The hand gun may also be characterized in that an element, projecting towards the exterior out from the groove (16), which is connected with the tensioning lever (14) or which is a part of the tensioning lever, forms the handle (15) for its actuation and is constructed for instance in the manner of a pin, a knob or a button.

The hand gun may be further characterized in that the element (15) is connected with a shaft, which projects in radial direction (transverse direction) into the groove (16) and is guided in the latter.

The following is a listing of reference numbers and associated components of illustrated embodiments:

10—firearm
11—grip piece
12—housing
13—connecting element
14—tensioning lever
15—handle
15*a*—handle
15*b*—handle
16—grooves
16*a*—groove
17—threaded bores
18—spring
19—thread

I claim:

1. A hand gun comprising:

a housing having a right hand side and a left hand side;

a tensioning lever wholly enclosed within the housing;

at least one handle for cocking the hand gun by movably actuating the tensioning lever relative to the housing in a longitudinal direction of the housing; and a plurality of discrete, alternative fastening bores formed in the tensioning lever and spaced apart from each other in the longitudinal direction of the housing for attaching the at least one handle to the tensioning lever at corresponding discrete, alternative fastening positions, wherein at least two of the fastening bores open toward the same side of the housing such that the at least one handle will extend externally from the same side of the housing when attached to either of said at least two fastening bores .

2. The hand gun according to claim 1, wherein along the housing at least three said fastening positions, respectively spaced apart from each other in the longitudinal direction of the housing, are provided for the handle for actuating the tensioning lever.

3. The hand gun according to claim 1, wherein on the right hand side and also on the left hand side of the housing respectively, at least one fastening position is arranged for the handle for actuating the tensioning lever.

4. The hand gun according to claim 1, wherein on the right hand side and also on the left hand side of the housing respectively, at least two alternative fastening positions, respectively spaced apart from each other in the longitudinal direction of the housing, are arranged for the handle for actuating the tensioning lever.

5. The hand gun according to claim 1, wherein the handle for actuating the tensioning lever is releasable from its respective fastening position by releasing a screw connection.

6. The hand gun according to claim 1, wherein a groove, open towards the exterior, on the housing of the hand gun is associated with at least one fastening position of the handle, into which groove the handle partially engages radially.

7. The hand gun according to claim 1, wherein at least one of an element of the handle and a connecting element to the tensioning lever is guided in a groove in the longitudinal direction during a cocking motion.

8. The hand gun according to claim 1, wherein a groove open towards the exterior, on the housing of the hand gun, is respectively associated with each said fastening position of the handle, into which groove the handle partially engages radially, and the length of this groove corresponds respectively to a path traversed by the handle during cocking of the hand gun.

9. The hand gun according to claim 6, wherein an element, projecting towards the exterior out from the groove, which is connected with the tensioning lever or which is a part of the tensioning lever, forms the handle for its actuation.

10. The hand gun according to claim 9, wherein the element is connected with a shaft, which projects into the groove in a direction perpendicular to the longitudinal direction, the shaft being guided in the groove.

11. The hand gun of claim 1, wherein the hand gun is a self-loading handgun.

* * * * *